United States Patent [19]

Iwamatsu

[11] Patent Number: 4,856,064

[45] Date of Patent: Aug. 8, 1989

[54] SOUND FIELD CONTROL APPARATUS

[75] Inventor: Masayuki Iwamatsu, Hamamatsu, Japan

[73] Assignee: Yamaha Corporation, Hamamatsu, Japan

[21] Appl. No.: 262,318

[22] Filed: Oct. 25, 1988

[30] Foreign Application Priority Data

Oct. 29, 1987 [JP] Japan ..... 62-273672

[51] Int. Cl.[4] ..... H04S 1/00

[52] U.S. Cl. ..... 381/1; 381/18

[58] Field of Search ..... 381/1, 17, 18, 19, 24, 381/62, 61, 63, 103; 84/DIG. 26

[56] References Cited

U.S. PATENT DOCUMENTS

| | | | |
|---|---|---|---|
| 4,275,267 | 6/1981 | Kurtin et al. | 381/18 |
| 4,549,289 | 10/1985 | Schwartz et al. | 381/71 |
| 4,731,848 | 3/1988 | Kendall et al. | 381/63 |
| 4,748,669 | 5/1988 | Klayman | 381/1 |
| 4,751,739 | 6/1988 | Serikawa et al. | 381/103 |
| 4,803,731 | 2/1989 | Niimi et al. | 381/63 |

*Primary Examiner*—Forester W. Isen

*Attorney, Agent, or Firm*—Spensley Horn Jubas & Lubitz

[57] ABSTRACT

A sound field control apparatus is provided with a memory storing first and second sound field data; a first digital sound processor convoluting the first sound field data to a sum signal of two channel stereophonic input signals to produce a first initial reflection sound signal group; and a second digital sound processor convoluting the second sound field data to a difference signal of the two channel stereophonic input signals to produce a second initial reflection sound signal group. Thus, sound field reproduction which is richer in flexibility and change can be materialized. Sound fields created by the sound field data supplied to each digital sound processor can independently be changed and thereby it is possible to cause the sound field reproduction to be widely varied as a whole.

4 Claims, 3 Drawing Sheets

SOUND FIELD CONTROL APPARATUS

BACKGROUND OF THE INVENTION (a) Field of the Invention

This invention relates to a sound field control apparatus producing a desired sound field in reproduction of two channel stereophonic input signals.

(b) Description of the Prior Art

In the past, a sound field control apparatus of this type has been used in general with the intention of reproducing a sound field which is accommodated in a sound source in recording, as exactly as possible. Alternatively, however, an apparatus producing desired sound fields such as music halls and churches, independently of the sound field in recording, has recently been developed (Refer to, Radio Technology, "Creating sound field—the world of omnisound with YAMAHA DSP-1", Aug. 20, 1986).

Such an apparatus is adapted to store time delay and level of a signal, as sound field data, to be supplied to each of loudspeakers for sound field reproduction in order to reproduce imaginary sound source distribution previously measured in, for example, famous music halls in the world, execute convolution operation processing with the sound field data for two channel stereophonic input signals derived from the sound source in reproduction, and output an initial reflection sound signal group produced for each loudspeaker to a plurality of sound field reproducing loudspeakers.

To make sound field creation with this system, such a fundamental arrangement as shown in FIG. 1 is suggested. In this figure, signals L, R for individual channels of two channel stereophonic signals inputted to input terminals lL, lR are supplied to loudspeakers LS, RS for a sound source which are placed on the left and right side, respectively, through power amplifiers not shown, and are converted into sound thereat. On the other hand, a digital sound processor (DSP) 2 convolutes the sound field data stored in a memory not shown to the sum or difference (a difference signal (L−R)is shown in FIG. 1) of the individual channel signals and outputs such an initial reflection sound signal group shown in FIG. 2 to loudspeakers FL, FR, RL, RR for exclusive use of sound field reproduction which are arranged at four corners of a room. As result, many of imaginary sound sources distributed among the loudspeakers FL, FR, RL, RR are reproduced and excellent sound field reproduction appropriate to the selected music hall is brought about.

However, in such a conventional arrangement in the case where a sum signal (L+R) of individual channel signals for stereophonic signals is employed for the sound field reproduction, when the signal (L+R), which is a component localized in a center position of right and left, is inputted to the DSP 2, a component such as a conversation to be localized in the center position will also be scattered around and consequently may bring about unnatural sound field reproduction.

In contrast to this, where the difference signal (L−R) is employed, the component localized in the center position, such as a conversation, can secure the sound field reproduction as it is and does not cause the unnatural reproduction mentioned in the preceding paragraph. Nevertheless, since the energy of the component localized in the center position is not increased in intensity as compared with that of the component (L−R) other than the component localized in the center position, the component such as a conversation will relatively be weakened. Further, it may be more convenient to add appropriate sound field reproduction to the conversation per se. Although, for example, where a moving picture is viewed, it is effective to add the sound field coincident with a scene of the moving picture to its tone (corresponding to the component localized in the center position), the use of the signal (L−R) makes it impossible to meet such requirements. This is because only one of the signals (L+R) and (L−R) contributes to the sound field reproduction as the input of the DSP 2.

SUMMARY OF THE INVENTION

An object of the present invention is to provide a sound field control apparatus of the type which can realize sound field reproduction which is richer in flexibility and change.

Another object of the present invention is to provide a sound field control apparatus which can control each sound field to bring about extremely natural sound field reproduction as a whole.

The sound field control apparatus according to the present invention is provided with a memory storing first and second sound field data, a first signal processing device convoluting the first sound field data to a sum signal of two channel stereophonic input signals to produce a first initial reflection sound signal group, and a second signal processing device convoluting the second sound field data to a difference signal of the input signals to produce a second initial reflection sound signal group.

According to the present invention, the first and second signal processing devices can make the creation of sound fields, independently of each other, with respect to a component localized in a center position of right and left and a component other than it. In other words, the sound field created by the sound field data supplied to each signal processing device can independently be changed and, as a result, it is possible that the sound field reproduction is changed in various manners as a whole.

These and other objects as well as the features and the advantages of the present invention will become apparent from the detailed description of the preferred embodiments when taken in conjunction with the accompanying drawings.

DESCRIPTION OF THE PREFERRED EMBODIMENT

Figure 1:
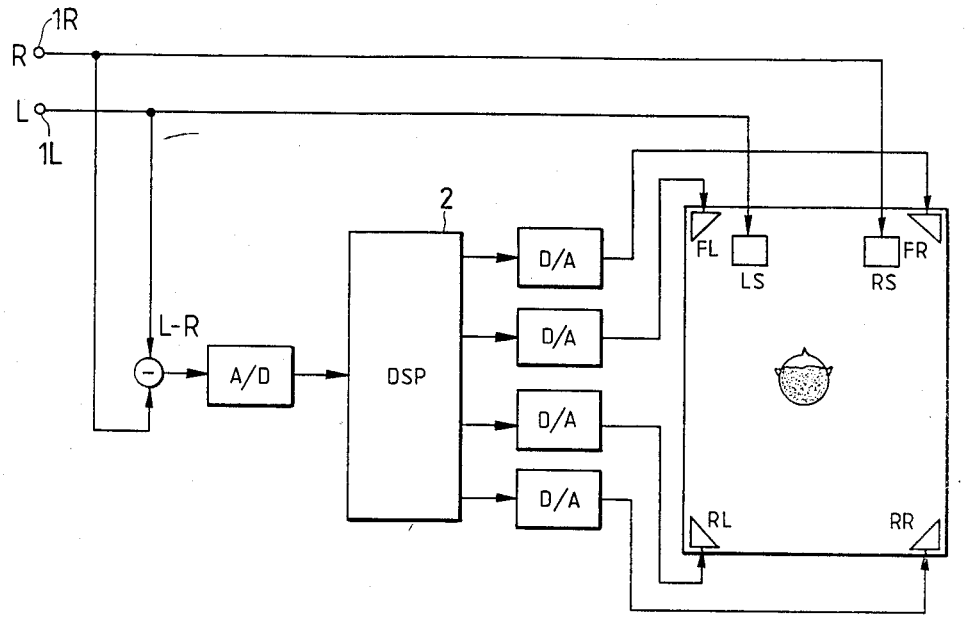
FIG. 1 PRIOR ART
FIG. 1 is a block diagram showing a conventional sound field control apparatus.
Figure 4:
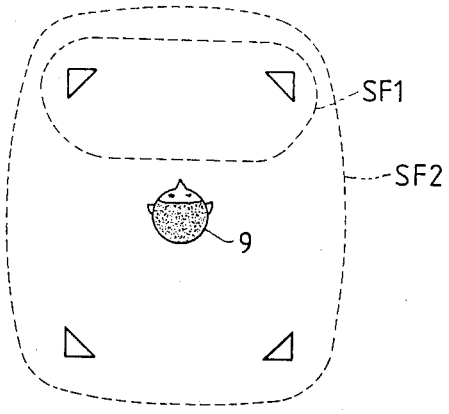
FIG. 4 is a view showing an example of a sound field formed by the apparatus of FIG. 3.
Figure 3:
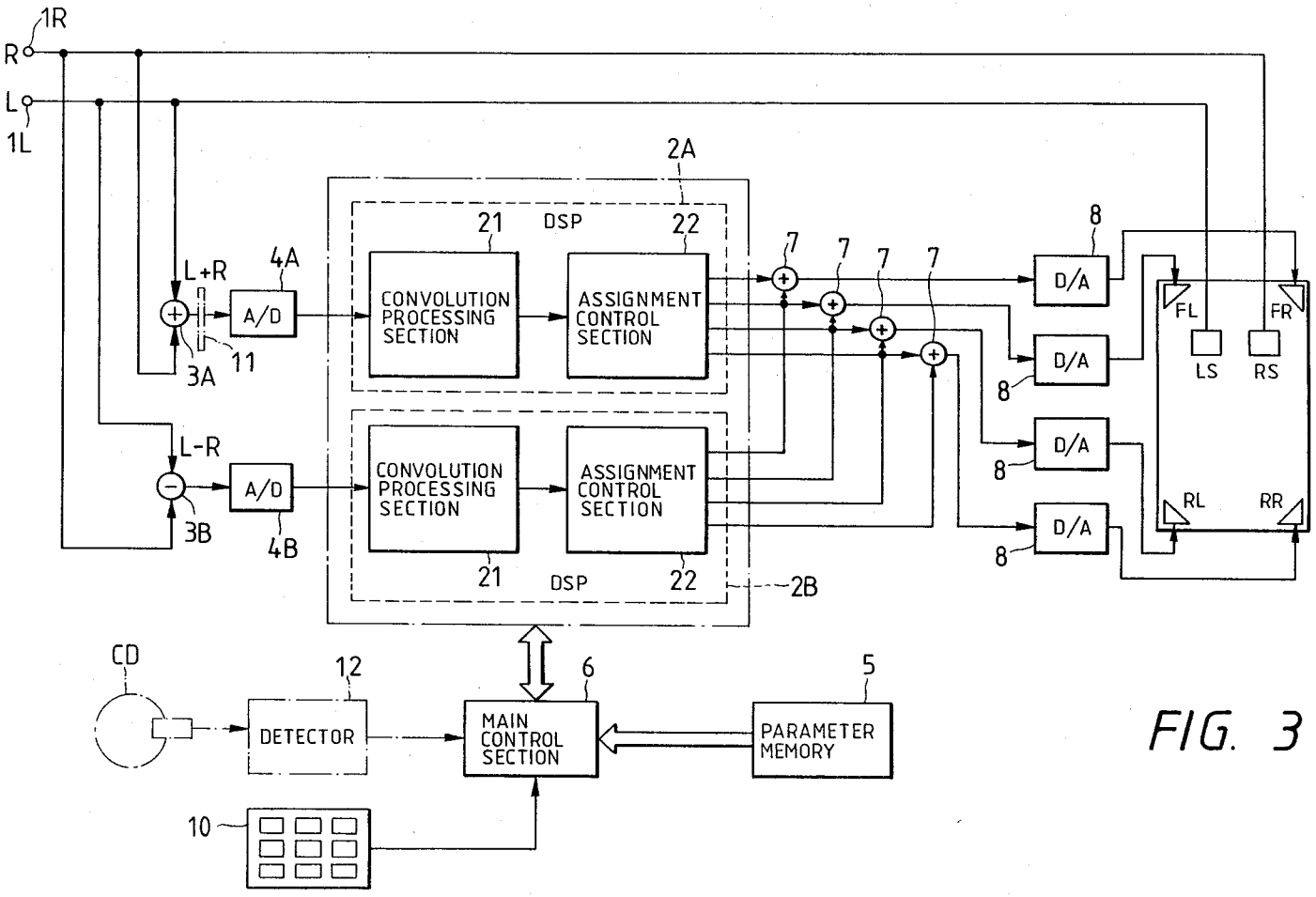
FIG. 3 is a block diagram showing an embodiment of a sound field control apparatus according to the present invention.

Referring to FIGS. 3 and 4 of the accompanying drawings, an embodiment of the present invention will be described in the following. In the explanation of the drawings, like reference numerals and symbols are used to designate like elements for the omission of a repeating description.

In FIG. 3, an apparatus of this embodiment is provided with two pairs of DSPs 2A, 2B. To the DSP 2A, on the one hand, is inputted a sum signal (L+R) in which signals of individual channels are added by an adder 3A, after converted into a digital signal through an analogue/digital (A/D) converter 4A. On the other hand, to the DSP 2B is inputted a difference signal (L−R) in which the subtraction of signals of individual channels is made by a subtracter 3B, after converted into a digital signal through an A/D converter 4B. Both the DSPs 2A, 2B are constructed from LSIs for high-speed operation and have convolution processing sections 21 and assignment control sections 22.

Figure 2:
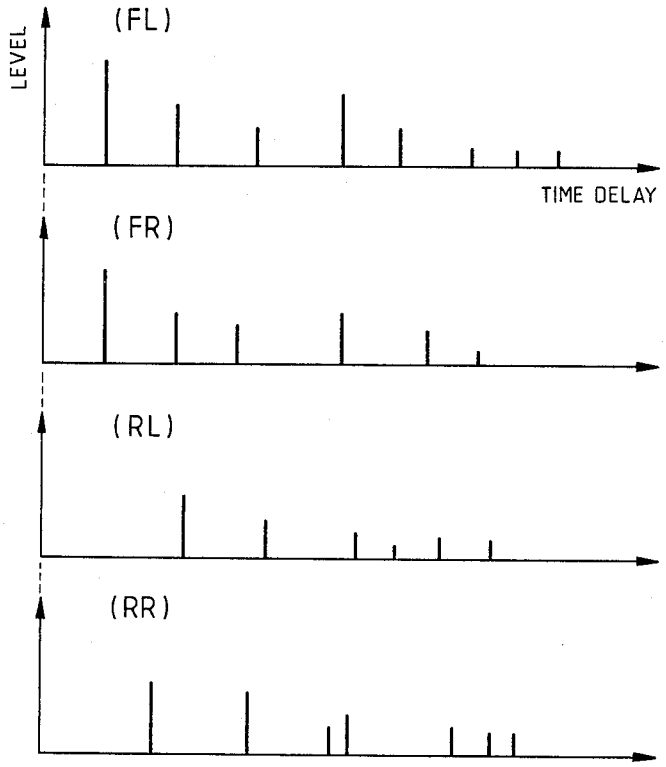
FIG. 2 is time charts showing an example of signals supplied to loudspeakers for sound field reproduction.

In a parameter memory 5, the time delay and level of signals to be supplied to the loudspeaker FL, FR, RL, RR for exclusive use of sound field reproduction are stored as sound field data to reproduce a desired imaginary sound source distribution. Here, the signals to be fed to individual loudspeakers speakers corresponds to reflection sounds to be outputted from the loudspeakers in order to reproduce the reflection sounds emanating from an imaginary sound source and are represented as time charts in which a plurality of reflection sound signals with different levels form particular array along time axes as depicted in FIG. 2. Therefore, the data stored in the parameter memory 5 includes data combinations of much time delay and level constituting the time charts.

Further, in fact, the embodiment is designed so that sound field patterns to be reproduced as mentioned above are plurally provided in accordance with the imaginary sound source distribution of music halls, churches etc. and, through the operation of manipulators provided on a control panel 10 connected to a main control section 6 comprising a microcomputer for control, a user can select his desired pattern.

The main control section 6 inputs a data group corresponding to the selected sound field pattern from the parameter memory 5 and feeds the data group to the DSPs as an initial reflection sound parameter. Of this data group, data indicative of the time delay and level of a signal is supplied to the convolution processing section 21, which delays input signals in accordance with the data and adjusts the levels of delay signals. On the other hand, to the assignment control section 22 is supplied data indicating how many delay signals, different in delay time and level, produced in the convolution processing section 21 should be distributed to individual loudspeakers in accordance with the directions of imaginary sound sources. Thus, based on the input data, the assignment control section 22 selects data necessary for each loudspeaker among the delay signals inputted from the convolution processing section 21, and assigns the data to each loudspeaker as the same signal array as shown in FIG. 2. Such is fundamental operation which is common to the sound field control apparatus using the DSP.

Here, in response to the fact that the embodiment is provided with two DSPs 2A, 2B, initial reflection sound parameters corresponding to two types of sound field different in characteristic are stored in the parameter memory 5 for each sound field pattern to be finally realized. Of these parameters, a first group of initial reflection sound parameters is fed to the DSP 2A, which executes thus the convolution operation processing previously mentioned with respect to the sum signal (L+R) corresponding to the component localized in the center position and produces and outputs a first initial reflection sound signal group to form a first sound field for each loudspeaker. On the other hand, a second group of initial reflection sound parameters is transmitted to the DSP 2B, which executes thus the convolution operation processing in regard to the difference signal (L−R) which is the component other than the component localized in the center position and outputs a second initial reflection sound signal group to form a second sound field. The initial reflection sound signal groups, directed to the same loudspeakers, outputted from the DSPs 2A, 2B are each added by an adder 7 and outputted through a digital/analogue (D/A) converter 8 to any of the loudspeakers FL, FR, RL, RR.

This embodiment is set so that the first group of initial reflection sound parameters provides locally a first sound field SFl only in the vicinity of the loudspeakers FL, FR, as shown in FIG. 4, while on the other hand, the second group of initial reflection sound parameters provides a second sound field SF2 involving the entire location of the loudspeakers FL, FR, RL, RR. An audience 9 picks up a reproduced sound synthesizing both the sound fields. Also in respect of the component (L+R) localized in the center position, such as a conversation, energy is adequately increased in intensity and it does not occur that the energy is unnaturally diffused in the entire room, with the result that sound field reproduction which is extremely natural as a whole is available.

The formations of the first sound field derived from the component localized in the center position and of the second sound field from the component other than that localized in the center position can independently be changed by varying the setup of the first and second groups of initial reflection sound parameters, thus allowing the sound field reproduction to be changed in various manners as a whole. It is also easy that, for example, the component such as a conversation is diffused in the entire room.

The present invention is not limited to the embodiment described above and can provide various modifications.

For instance, although the above embodiment is constructed so that the DSP delays input signals in accordance with predetermined time charts and assigns the signals to individual loudspeakers while adjusting the levels, the arrangement may be made so that delay signals necessary for individual loudspeakers are selected before level adjustment is made.

Further, because the component (L+R) localized in the center position is principally formed by a conversation, it may be preferred to raise the clarity of the conversation rather than reproduce exactly the sound field. In such a case, the arrangement may be made so that a band-pass filter 11 appropriate for the input of the signal (L+R) is inserted to eliminate high- and low-frequency bands of minor importance.

In addition, the setup of the first and second initial reflection sound parameters does not require to be fixed with respect to a sound source and may be such as to be switched in turn for each scene represented in the sound source. For example, in the case where the movement of the scene from a concert hall to a street and further to a seaside is involved in the recording contents of a CD (compact disc), when the apparatus is set so that a specific trigger signal is previously recorded in the CD every time the scene is changed and the main control section 6 detecting the signal through a detector 12 indicated by a chain line in FIG. 3 changes the parameter group fed to the DSPs 2A, 2B in accordance with the signal, it follows automatically changes of scenes and can provide the sound field reproduction suitable for each scene.

According to the present invention, as described above, the sound field creation is separately made, by the use of two DSPs, with respect to both the sum and difference signals derived from the left- and right-hand input signals of the two channel stereophonic input signals and thereby the variation of the sound field reproduction available as a whole can be made considerably wide with a relatively simple arrangement. Further, proper adjustment of each sound field facilitates the attainment of the sound field reproduction which is made extremely natural as a whole.

What is claimed is:

1. A sound field control apparatus comprising:

a memory storing first and second sound field data corresponding to desired imaginary sound source distribution;

first signal processing means convoluting the first sound field data read out of said memory to a sum signal of two channel stereophonic input signals to produce a first initial reflection sound signal group; and second signal processing means convoluting the second sound field data read out of said memory to a difference signal of said two channel stereophonic input signals to produce a second initial reflection sound signal group, said first and second initial reflection sound signal groups being outputted to a plurality of loudspeakers for sound field reproduction.

2. A sound field control apparatus according to claim 1, further comprising a band-pass filter through which said sum signal is inputted into said first signal processing means to eliminate high- and low-frequency bands.

3. A sound field control apparatus according to claim 1, wherein said memory stores the first and second sound field data as plural data each and said apparatus further comprises operating means which is capable of selectively inputting the data from said memory into said first and second signal processing means to select sound field patterns to be reproduced.

4. A sound field control apparatus according to claim 1, wherein said memory stores the first and second sound field data as plural data each and said apparatus further comprises signal control means which is capable of inputting the data at any time from said memory into said first and second signal processing means to automatically change sound field patterns to be reproduced.

* * * * *